United States Patent [19]

Grosser et al.

[11] 3,994,106

[45] Nov. 30, 1976

[54] PANEL CONSTRUCTIONS

[75] Inventors: Christian E. Grosser, Richmond; Jack M. Roehm, Virginia Beach, both of Va.

[73] Assignee: Grosser Enclosures Company, Richmond, Va.

[22] Filed: Oct. 8, 1975

[21] Appl. No.: 620,741

Related U.S. Application Data

[62] Division of Ser. No. 521,458, Nov. 6, 1974, Pat. No. 3,945,160.

[52] U.S. Cl. ..... 52/225; 52/81; 52/573

[51] Int. Cl.[2] ..... E04B 1/40; E04B 7/10

[58] Field of Search ..... 52/81, 80, DIG. 10, 52/397, 14, 285, 245, 501, 498, 27, 500, 476, 758 H, 753 D, 656, 86, 227, 82, 582

[56] References Cited

UNITED STATES PATENTS

| | | | |
|---|---|---|---|
| 2,433,677 | 12/1947 | Thomas | 52/82 |
| 3,744,191 | 7/1973 | Bird | 52/81 |
| 3,918,233 | 11/1975 | Simpson | 52/81 |

*Primary Examiner*—John E. Murtagh
*Attorney, Agent, or Firm*—Strauch, Nolan, Neale, Nies & Kurz

[57] ABSTRACT

Panel constructions which can be assembled into building structures of various sizes, shapes, and types and systems for attaching the panels to each other.

4 Claims, 6 Drawing Figures

PANEL CONSTRUCTIONS

This application is a division of application No. 521,458 filed Nov. 6, 1974 (now Pat. No. 3,945,160).

The present invention relates to novel, improved panels from which self-supporting building structures can be fabricated and to novel, improved systems for fastening the panels together and for sealing the joints therebetween.

The use of triangular and other polygonal panels as building components is in itself a known concept as shown by U.S. Pat. Nos. 2,440,449 issued Apr. 27, 1948; 2,682,235 issued June 29, 1954; 2,711,181 issued June 21, 1955; 2,918,992 issued Dec. 29, 1959; 3,061,997 issued Nov. 6, 1962; 3,094,708 issued June 25, 1963; 3,114,176 issued Dec. 17, 1963; 3,137,371 issued June 16, 1964; 3,192,669 issued July 6, 1965; 3,203,144 issued Aug. 31, 1965; 3,344,565 issued Oct. 3, 1967; 3,359,694 issued Dec. 26, 1967; 3,530,621 issued Sept. 29, 1970; 3,557,501 issued Jan. 26, 1971; and 3,640,034 issued Feb. 8, 1972.

Our novel panel constructions, however, are different from and have a number of important advantages over those heretofore proposed.

One is that, although only a limited variety of panels is employed, they are so designed that they can be assembled into structures of different sizes and shapes and even into self-supporting structures useful as or in roofs for building structures constructed by other techniques.

Another advantage of our invention is that we can provide building structures which are rectangular in plan. This is unusual in panel-type construction and important; it simplifies the construction of foundations, increases compatibility with conventional wall structures, and makes the most efficient use of the area occupied by the structure.

Another advantage is that building structures can be erected from our novel panel constructions with a minimum of labor. Also, erection is sufficiently simple that expertise is not required.

In addition, individual panels can be readily removed from the structures into which they are assembled. This is important from the maintenance point-of-view.

Furthermore, our novel panel constructions readily lend themselves to partial pre-fabrication. In many applications erection costs can be reduced by assembling at least part of the panels into sections before they reach the erection site.

Also, the problem of introducing service facilities into building structures assembled from our novel panel constructions are minimal because this can be done at virtually any joint. A related advantage is that certain of our novel panel constructions have frames with passages suitable for housing electrical, plumbing, and other services.

This type of panel consists of a main member of relatively large area. This member is surrounded by a frame composed of two members with the main panel member and a compressible seal confined therebetween. The frame members are of readily extrudable configurations and also of configurations which permit one member to be displaced with respect to the other to adjust the clamping force on the main panel member and the compressible seal. Both of these features are important, the first from the cost point-of-view and the second because it permits an effective seal between the main panel member and the frame to be easily achieved.

Another advantage of our novel frame members just described is that they can readily be provided with integral ancillary components such as gutters for collecting and draining off condensate, for example.

Another advantage of these novel panels is that the frames are torsionally rigid unlike many previously employed panels which are free to rack or twist. Torsional rigidity permits the main panel member to be made of relatively fragile and brittle materials such as glass and acrylic plastics. This is important in applications where a panel capable of transmitting light is wanted.

As mentioned above, the panels we employ are typically of triangular configuration. The frames are made in three sections, and the ends of the sections are mitered at the corners of the panel. An important advantage of this arrangement is that the frame sections can be secured together by simple, flanged, triangular, sheet metal clips, a technique which is both effective and inexpensive.

Panels of the character just described can be secured to adjacent panels in the edge abutted relationship we employ by bolting together the frame members of adjacent panels. This erection technique is both simple and inexpensive.

A related and novel feature of our invention is the provision of wedges which can be inserted between adjacent frame members to span the gap therebetween which will exist at certain of the dihedral angles at which adjoining panels may meet. This makes the joint rigid which is of obvious importance.

Those frame members which are intended to be assembled to the frame members of adjoining panels preferably have a V-like face configuration which accommodates variations in dihedral angle. Facing recesses near the apices of the V-shaped faces support compressible seals which span the two frame members and seal the gap therebetween. Location of the seals as just described is important because it makes the effectiveness of the seal independent of the dihedral angle between the panels.

At those locations where corners or apices of the panels meet, an effective seal can be provided by securing a washer-like seal in place with a self-tapping fastener. Again, the technique is simple and effective.

Another novel type of panel embodying the principles of the present invention consists of a main member with a flexible seal extending continuously around its periphery. These panels have the advantages of maximum simplicity and low cost.

Panels of this type are fixed in edge abutting relationship with the seals of adjoining panels closing the gap therebetween by connectors at the locations where the corners of the panels meet, which also seal any gaps existing at such locations, and tension members extending between adjacent pairs of connectors. Virtues of this system are simplicity and ease of erection. Also, because there are no metal frame members and because the main panel members will tend to be somewhat thicker, this construction will often have a greater heat insulating effect than other types of structures.

We prefer, in employing this type of construction, to make the connection between one (or both) ends of each tension member and the associated connector through a constant force applying device. This is a simple and effective technique for accommodating the thermal expansion and contraction which occurs as the ambient temperature changes. Also, the use of a constant force spring device reduces erection costs by making it possible to easily provide the wanted stress in the tension members.

Techniques for assembling panels in edge abutting relationship have of course been proposed and are shown, for example, in U.S. Pat. Nos. 1,970,404 issued Aug. 14, 1934; 2,085,281 issued June 29, 1937; 2,278,956 issued Apr. 7, 1942; 2,343,764 issued Mar. 7, 1944; 2,668,509 issued Feb. 9, 1954; 2,881,717 issued Apr. 14, 1959; 3,014,558 issued Dec. 26, 1961; 3,090,162 issued May 21, 1963; 3,139,958 issued July 7, 1964; 3,206,895 issued Sept. 21, 1965; 3,550,335 issued Dec. 29, 1970; and 3,660,952 issued May 9, 1972; in Canadian patent no. 670,583 issued Sept. 17, 1963; and in British Pat. Specification No. 1,002,301 published Aug. 25, 1965. Clips for securing frame members together have heretofore been proposed as shown by U.S. Pat. No. 547,585 issued Oct. 8, 1895. Nevertheless, none of the above-listed patents nor any others of which we are aware disclose panel constructions or assembly techniques therefor having the advantages of those we employ as discussed above.

The applications of our invention are virtually limitless. Building structures fabricated in accord with its principles can be employed to enclose swimming pools, tennis courts, and other areas, for storage, and for many other purposes. The structures can be so constructed as to completely enclose the covered area or to be partly open; and access to the interior of the structure can easily be provided.

From the foregoing it will be apparent to the reader that one important and primary object of our invention resides in the provision of novel, improved, panel constructions from which building structures can be erected.

Related and important but more specific objects of our invention reside in providing panel constructions in accord with the preceding object:

1. which are capable of being mass produced to accurate dimensions;

2. which can be assembled into sections prior to erection of the building in which they are incorporated to thereby expedite the on-site erection process;

3. which are simple;

4. which can be produced at a relatively low cost;

5. which, in conjunction with the preceding object, employ frame members of readily extrudable configurations;

6. which, in conjunction with object 4, consist of a main member and a compressible peripheral seal;

7. which can be easily assembled;

8. which have a highly effective seal between a main member and a frame extending around and supporting the main member;

9. which have a torsionally rigid peripheral frame construction, permitting the main member of the panel to be made from a relatively fragile and/or brittle material;

10. which have integral gutters for carrying condensed moisture away;

11. which have a main member surrounded by plural frame sections and simple frictional retainers for securing the frame sections together.

Yet another important and primary object of the present invention resides in the provision of novel, improved systems for securing panel constructions together in edge abutted relationship to form a variety of building structures.

Related important but more specific objects of the invention include systems in accord with the preceding object:

12. which permit adjoining panels to be secured together in a manner which will result in a solid joint therebetween independently of the angle of dihedral between the panels;

13. which permit adjoining panels to simply be bolted together;

14. which afford effective sealing between the abutted edges of adjoining panels and at those locations where the corners of panels meet;

15. which effectively accommodate thermal expansion and contraction of the assembled panels;

16. which, in conjunction with the preceding object, include connectors clamping the panels together at locations where their corners meet, tension members extending between adjacent connectors, and constant force spring devices for keeping the tension in said members constant as the panels expand and contract.

Other important objects and features and additional advantages of our invention will become apparent from the appended claims and as the ensuing detailed description and discussion proceeds in conjunction with the accompanying drawing in which:

Figure 1:
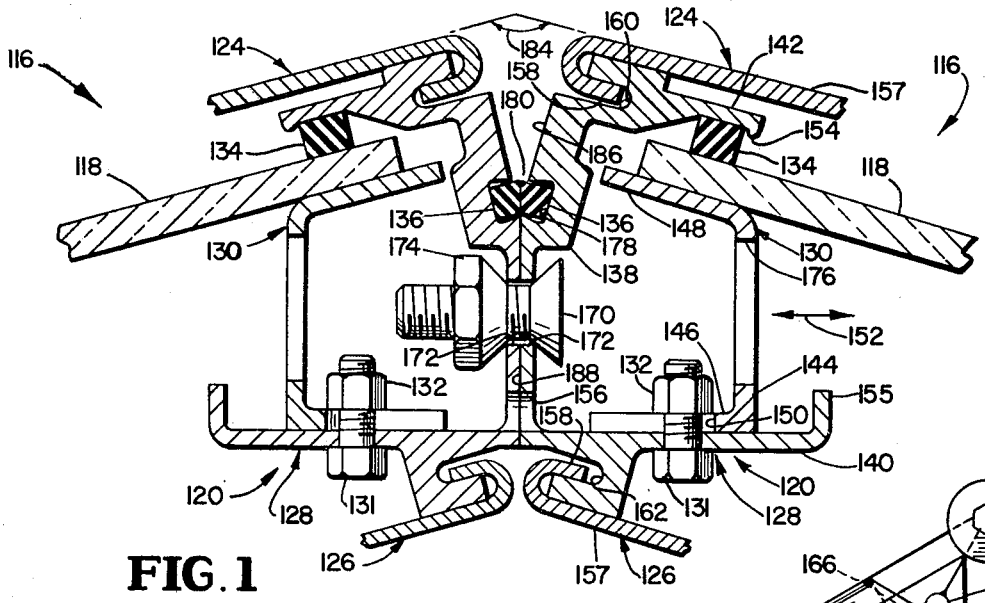
FIG. 1 is a partial section through two adjoining panels embodying the principles of our invention; it shows how the panels are constructed and assembled.
Figure 2:
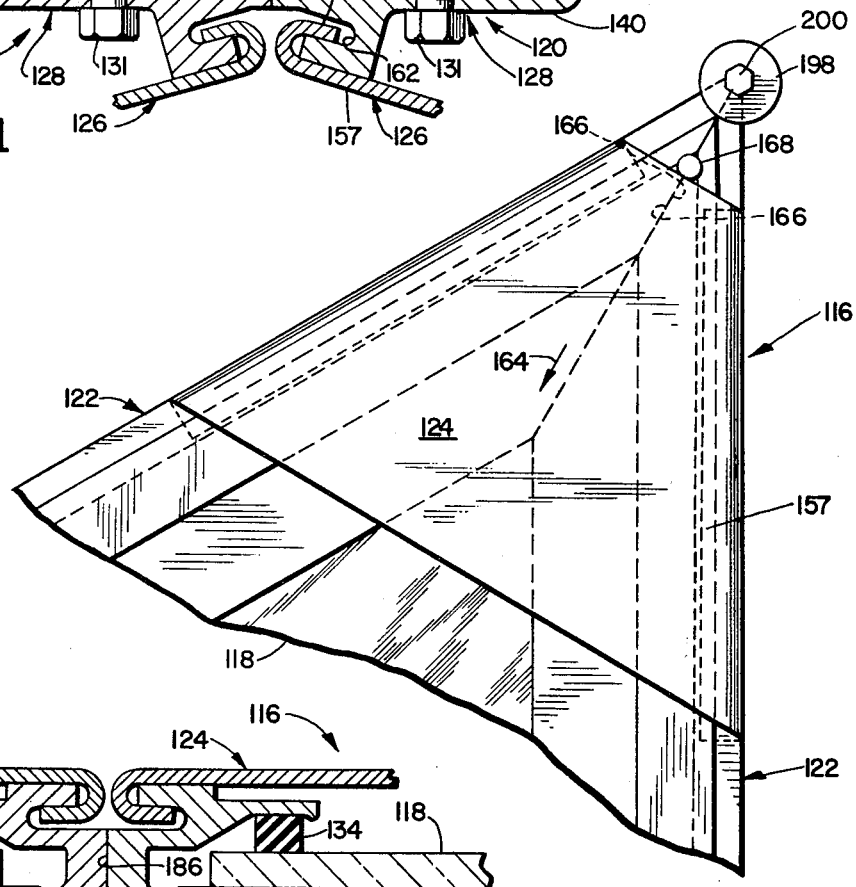
FIG. 2 is a partial plan view of a panel as shown in FIG. 1.
Figure 3:
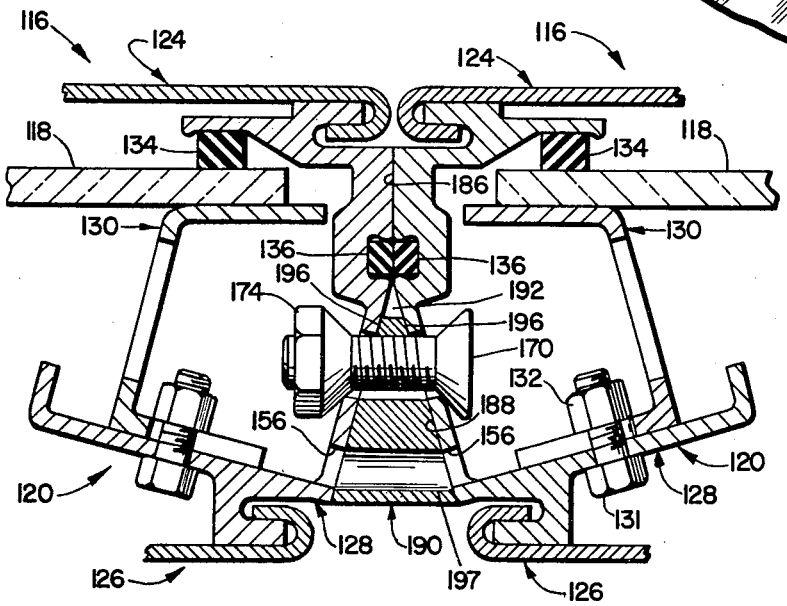
FIG. 3 is a view similar to FIG. 1 showing the novel technique we employ for accommodating variations in dihedral angle between adjoining panels.

Referring now to the drawing, FIGS. 1–3 show one exemplary type of panel construction in accord with the principles of the present invention from which the building structures we have invented can be fabricated. The triangular panels 116 shown in these figures have a triangular main body member 118, a frame 120 made up of three frame sections 122 (two of which are shown in FIG. 2), and triangular clips 124 and 126 for holding the frame sections 122 together.

The sheet or platelike main body members 118 of the panels can be made of relatively fragile, light transmitting materials such as glass, Plexiglass and other plastics, etc. This permits the building structures we have invented to be used for skylights, greenhouses, and swimming pool and tennis court covers and in other applications where natural illumination of the interior of the structure is wanted.

It is of course not necessary that the main panel members be made of the particular materials just described or, indeed of light transmitting materials at all. They can be made of wood, metal, or virtually any other structural material.

Furthermore, the main panel members do not have to be of the illustrated platelike configuration throughout. They may be of any cross-sectional configuration which does not interfere with the installation of frame 120 and retaining clips 124 and 126.

Also, the main panel members can be hinged for ventilation purposes; and they can be used to support other components of the building structure such as stacks, vents, etc. A myriad of other modifications will be readily apparent to those to whom this application is directed.

Referring to FIG. 1, each of the frame sections 122 of the panel includes outer and inner frame members 128 and 130. Outer frame members 128 are mitered together at the corners or apices of the panels, and fasteners 131 and retainers 132 are provided for fastening the inner and outer frame members together. There are also a gasket 134 which furnishes a seal between frame 120 and main panel member 118 and a second gasket 136, which co-operates with a similar gasket or seal in the adjoining panel of an assembled structure to seal the joint therebetween.

Frame members 128 and 130 can be extruded from aluminum and alloys of this and other metals, for example, or formed by other manufacturing techniques. Frame members 128 have a central section 138 and transversely extending legs 140 and 142 at opposite ends of the center section.

Inner frame members 130 are of generally the same configuration as frame members 128. They have a central section or portion 144 and legs 146 and 148.

Each frame member 130 is supported from the leg 140 of the associated frame member 128. Elongated slots 150 in leg 146, through which fasteners 131 extend, allow frame member 130 to be displaced relative to frame member 128 along a rectilinear path as indicated by double-headed arrow 152 in FIG. 1.

Main panel member 118 is supported by the legs 148 of the three inner frame members 130. Gasket 134, which extends the length of each frame section, is trapped between the main panel member and the leg 142 of the outer frame member 128. The leg has a depending, integral projection 154 for retaining the gasket in place.

As shown in FIG. 1, the upper legs 148 of frame members 130 are inclined wedges. Consequently, by displacing frame members 130 relative to frame members 128 along path 152, gasket 134 can be compressed between main panel member 118 and the legs of frame members 128 to a degree which will provide optimum sealing between the main panel member and the frame.

A further feature of frame 120 is the provision of flanges 155 extending the lengths of the legs 140 of frame members 128. These flanges convert frame members 128 into gutters for carrying away the condensate which may form on the insides of the building structures into which the panels are assembled. Weep holes 156 in frame member central sections 138 allow the condensate to flow from one panel to the next.

Referring now to both FIGS. 1 and 2, the generally triangular clips 124 and 126 by which the frame sections of the panels 116 are held together will typically be made of sheet metal. They have a main body portion 157 and flanges 158 which are integral with, generally parallel to, and extend toward the center of the clip.

Flanges 158 of clips 124 fit in grooves 160 formed in the upper or outer sides of converging frame members 128 and opening onto the ends thereof. The flanges of clips 126 fit in similar grooves 162 on the lower or inner sides of these members.

Clips 124 and 126 are displaced toward the center of the panel; i.e., in the direction shown by arrow 164 in FIG. 2, to clamp together the mitered ends 166 of the two frame sections 122 with which they are associated. The clips are retained in place by friction and, if desired, by retaining pins 168, the outer one of which is shown in FIG. 2.

Adjacent panels of the character just described are assembled in edge abutting relationship (i.e., with central sections 138 of the frame members 128 of adjacent panels butted) by fasteners 170, which extend through aligned apertures 172 in the frame members, and retainers 174. Access to the fasteners and retainers is afforded by apertures 176 in the central sections 144 of frame members 130.

Fastener, retainer combinations as just described are employed at intervals along the edge abutted frame sections 122. There is nothing critical about the distance between the fasteners. This is simply a function of conventional design criteria.

The gaskets 136 employed to seal the gaps between adjacent panels 116 are housed in recesses 178 opening onto the exterior faces of outer frame member central sections 138. With two panels disposed in edge abutting relationship as shown in FIG. 1, the two seals 136 are compressed against each other, sealing the wedge-shaped gap 180 between the panels.

When assembled into building structures of the type we have invented, the dihedral angle 184 between adjacent, edge abutted panels may vary from somewhat less than 150° (FIG. 1) to 180° (FIG. 3). To accommodate this variation, the central sections 138 of frame members 128 are given a V-shaped configuration; and the recesses 178 in which gaskets 136 are housed are located generally along the intersection between the two relatively inclined outer face portions 186 and 188 of the central frame sections. This insures that the two gaskets 136 of adjacent panels will remain in sealing arrangement over the entire range of dihedral angles which may be present in a building structure as is apparent from a comparison of FIGS. 1 and 3.

Referring now to FIG. 3, we preferably use tapered or wedge-shaped inserts 190 to make the joints between adjacent panels more rigid where the dihedral angle between adjacent panels is sufficiently large to leave a significant gap 192 between the lower face portions 188 of frame member central sections 138. Wedges 190 are employed at the same locations as fastener, retainer combinations 170, 174 and are secured in place by the latter.

Wedges 190 can be provided in such degrees of taper as may be deemed desirable. Generally, however, wedges with two different degrees of taper are sufficient. Typically, the included angle between the sides 196 of the wedges of one type will be on the order of 15° and those of the second type on the order of 30°.

Also, the wedges will preferably be provided with weep holes 197 matching those in frame members 128 so that condensate can drain from one panel to the next.

In addition to the components so far described, our novel system for assembling panels of the type shown in FIGS. 1–3 into self-supporting building structures includes washerlike gaskets 198 and retainers 200 which may be self-threading. The retainers are employed to fasten the gaskets over the juxtaposed ends of panels meeting at a common intersection and keep moisture, air, etc. from penetrating through the structure at these intersections.

Figure 4:
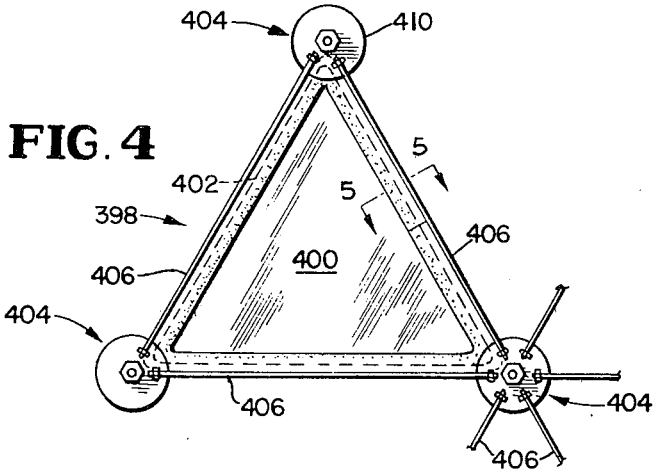
FIG. 4 is a partially schematic view of a second form of panel embodying the principles of the present invention and of the novel system we employ for assembling such panels.

Another type of panel which can be employed for our purposes and which is also exemplary of those embodying the principles of our invention is shown in FIG. 4 and identified by reference character 398. This panel, which is of the utmost simplicity, includes a triangular main member 400 surrounded by a compressible peripheral seal 402 (see also FIG. 5) cemented or otherwise fixed to the main panel member. The main member 400 may be of any of the mateials suggested above, and several compressible gasket materials which may be employed will readily suggest themselves to the reader.

Figure 5:
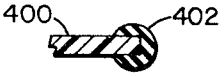
FIG. 5 is a section through the panel of FIG. 4 taken substantially along line 5—5 of FIG. 4.
Figure 6:
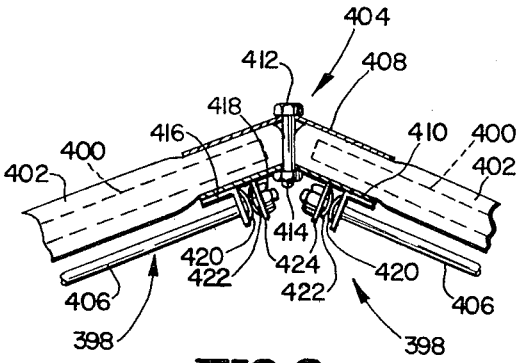
FIG. 6 is a partial section through two adjoining panels of the type illustrated in FIG. 4; it also shows additional details of the technique we employ for assembling the panels.

Panels of the character shown in FIGS. 4–6 are assembled in edge abutting relationship by connectors 404 and by tension members 406.

As shown in FIG. 6, each of the connectors 404 consists of an outer, disklike clamp member 408, an inner clamp member 410 of similar configuration, a fastener 412, and a retainer 414. Clamp members 408 and 410 engage the panels meeting at a common intersection on opposite sides thereof. The fastener 412 and retainer 414 bias the two clamping members toward each other to hold the panels engaged therebetween in assembled relationship.

Tension members 406 extend between the inner clamp members 410 of each pair of adjacent connectors and through brackets 416 fixed in any convenient fashion to the clamping members. Retainers 418 at the opposite ends of the tension members secure them in place. By threading these retainers along the tension members or fixtures attached thereto the desired tension in the members can be established.

It is preferred that a constant force spring device be interposed between the retainer 418 and bracket 416 at one (or both) ends of each tension member. This keeps the tension in the members essentially the same despite the differential thermal expansions and contractions which will occur among the various component materials as the ambient temperature changes.

The constant force spring device also simplifies the tensioning of members 406 in the erection process. Such devices typically exert a substantially constant force over a relatively wide range of deflection. Accordingly, if the workman simply tightens the retainer to approximately a mid (or other partial) deflection as determined by visual inspection, the desired amount of tension will be applied to members 406 and maintained despite relatively large dimensional changes.

One suitable form of constant force spring device consists of two Belleville springs 420 and 422 journalled in back-to-back relation on tension member 406 between the associated bracket 416 and retainer 418 at one end thereof. A flat washer 424 can be employed between Belleville spring 420 and retainer 418 to provide a larger bearing surface for the Belleville spring, if necessary.

It will be apparent that only exemplary panel constructions have been described and that many other such constructions can be produced by applying the principles of our invention. Accordingly, to the extent that they are not expressly excluded from the appended claims, all such panel constructions are fully intended to be embraced therein.

Our invention may be embodied in other specific forms without departing from the spirit or essential characteristics thereof. The present embodiments are therefore to be considered in all respects as illustrative and not restrictive, the scope of the invention being indicated by the appended claims rather than by the foregoing description; and all changes which come within the meaning and range of equivalency of the claims are therefore intended to be embraced therein.

What is claimed and desired to be secured by Letters Patent is:

1. The combination of building panels arranged in edge abutted relationship about a plurality of points and means for fixing said panels in said edge abutted relationship which comprises a connector means engaged at each of said points with the panels thereat, a tensioned member fixed to and extending between each pair of adjacent connector means, and means for keeping the tension in the tensioned members substantially constant despite differential thermal expansions and contractions of the panels and associated components.

2. The combination defined in claim 1 wherein the means for keeping the tension in the tensioned members substantially constant comprises, at one end of each such member, a retainer fixed to the member, an abutment means rigid with the associated connector means, and a generally constant force spring means disposed between said retainer and said abutment means.

3. The combination of claim 1 wherein each connector means comprises members engageable with opposite sides of the assemblage of panels meeting at the point where the connector means is located and fastener means for clamping said members against said panels.

4. The combination of claim 1 wherein the panels each comprise a main body member and an elastic seal means extending continuously around the main body member.

* * * * *